US005794705A

United States Patent [19]

Kim et al.

[11] Patent Number: 5,794,705

[45] Date of Patent: Aug. 18, 1998

[54] FIRE EXTINGUISHING APPARATUS HAVING A SPRAYING NOZZLE ASSEMBLY

[75] Inventors: Myung Bae Kim; Yong Bae Jang, both of Daejeon, Rep. of Korea

[73] Assignee: Korea Institute of Machinery and Metals, Daejeon, Rep. of Korea

[21] Appl. No.: 917,731

[22] Filed: Aug. 27, 1997

Related U.S. Application Data

[63] Continuation-in-part of Ser. No. 626,420, Apr. 2, 1996, abandoned.

[30] Foreign Application Priority Data

Apr. 7, 1995 [KR] Rep. of Korea ..... 95-8033

[51] Int. Cl.[6] ..... A62C 37/44

[52] U.S. Cl. ..... 169/61; 239/488

[58] Field of Search ..... 169/5, 13, 37, 169/60, 61, 70; 239/209, 487, 488, 548

[56] References Cited

U.S. PATENT DOCUMENTS

| | | | |
|---|---|---|---|
| 916,984 | 4/1909 | Bleymehl | 239/548 X |
| 2,699,217 | 1/1955 | Elmenhorst | 239/488 X |
| 3,504,893 | 4/1970 | Susuki et al. | 239/488 |
| 3,866,687 | 2/1975 | Banner | 169/61 |
| 4,836,290 | 6/1989 | Le Lande, Jr. | 169/61 X |

*Primary Examiner*—Andrew C. Pike

*Attorney, Agent, or Firm*—Beveridge, DeGrandi, Weilacher & Young LLP

[57] ABSTRACT

A fire extinguishing apparatus can quickly extinguish a fire in the early stages by ejecting a pressurized liquid in the form of a fine spray, and can effectively extinguish a fire even when an extensive fire occurs. The apparatus has a frame, a cap member assembled into the upper portion of the frame, and a spraying nozzle assembly coupled to the underside of the frame. The spraying nozzle assembly has a plurality of nozzle sections. The nozzle section includes a hollow nozzle body, a swirler accommodated in the hollow nozzle body in order to apply centrifugal force to the highly pressurized liquid passing therethrough, a swirler holder which is inserted in the upper portion of hollow nozzle body and contacts with the upper surface of the swirler so as to prevent the swirler from moving, and a nozzle tip having an orifice for spraying the pressurized liquid to the fire. The nozzle tip is inserted in the lower portion of the hollow nozzle body.

13 Claims, 3 Drawing Sheets

FIRE EXTINGUISHING APPARATUS HAVING A SPRAYING NOZZLE ASSEMBLY

CROSS-REFERENCE TO RELATED APPLICATION

This application is a continuation in part of U.S. application Ser. No. 08/626,420, filed Apr. 2, 1996, now abandoned.

BACKGROUND OF THE INVENTION

1. Field of the Invention

The present invention relates to a fire extinguishing apparatus, and more particularly to a fire extinguishing apparatus having an improved spraying nozzle assembly, which transforms a liquid into fine particles by using high pressure and ejects the fine particles to a fire, thereby effectively extinguishing the fire.

2. Prior Art

Generally, a sprinkler system is used in a building or room for extinguishing a fire.

A conventional sprinkler system has a hydraulic pump which applies pressure to liquid supplied from a liquid source, an alarm valve connected to the hydraulic pump through a first liquid pipe so as to sound an alarm when a fire breaks out, a spraying nozzle connected to the alarm valve through a second liquid pipe in order to spray the pressurized liquid to the exterior of the system, and a sprinkler head.

The sprinkler head includes a fusible link which melts as the room temperature increases over a predetermined temperature (i.e., a melting point of the fusible link) due to a fire, and a deflector which deflects the flow of the pressurized liquid at a predetermined angle so that the pressurized liquid can spray widely to the exterior.

In the normal state, the fusible link blocks a liquid outlet so that the pressure liquid may stay in the first and second liquid pipes.

The sprinkler system being constructed as described above operates as follows.

When the room temperature increases over a predetermined temperature due to a fire, the fusible link melts. As the fusible link is melted, the pressurized liquid which is filled in the second liquid pipe flows to the sprinkler head through the spraying nozzle.

Then the pressurized liquid that has flowed to the sprinkler head is sprayed to the exterior through the deflector. As mentioned above, since the flow of the pressurized liquid is deflected at a predetermined angle while it passes through the deflector, the pressurized liquid may spray widely to the exterior.

In the meantime, since the pressurized liquid filled in the second liquid pipe is sprayed to the exterior, pressure in the second liquid pipe drops below the pressure in the first liquid pipe, so that the pressurized liquid filled in the first liquid pipe passes through the alarm valve. While the pressurized liquid passes through the alarm valve, the alarm valve sounds a fire alarm. The pressurized liquid that has passed the alarm valve is sprayed to the exterior by way of the second liquid pipe, the spraying nozzle, and the sprinkler head.

On the other hand, when pressure in the first liquid pipe drops as compared with a predetermined value, the pressurized liquid is supplied from the liquid source to the first liquid pipe through the hydraulic pump.

However, the conventional sprinkler system has the following disadvantages.

Firstly, since particles of the sprayed liquid are bulky, the spray range of the sprayed liquid may be confined within narrow limits due to its weight so that a large quantity of the liquid is required to extinguish a fire.

Further, it takes a long time to vaporize the bulky particles; therefore it is difficult to quickly extinguish the fire.

Furthermore, the sprinkler system does not operate when the room temperature is lower than the melting temperature of the fusible link; therefore it is impossible to extinguish the fire in the early stages.

Accordingly, there is a need to provide a fire extinguishing apparatus which can quickly extinguish a fire in the early stages, and can effectively extinguish the fire even when an extensive fire occurs.

SUMMARY OF THE INVENTION

The present invention has been made to overcome the above described problems of the prior arts, and accordingly it is an object of the present invention to provide a fire extinguishing apparatus which can quickly extinguish a fire in the early stages by ejecting a pressurized liquid in the form of a fine spray, and can effectively extinguish a fire even when an extensive fire occurs.

To achieve the above object, the present invention provides a fire extinguishing apparatus comprising:

- a smoke sensor installed in a room for sensing smoke in the room;
- a heat sensor installed in the room for sensing temperature in the room;
- an electrical control unit connected to both the smoke and heat sensors for generating a control signal when a fire sensing signal is inputted to the electrical control unit from the smoke sensor or the heat sensor;
- a remote controlled valve connected to the electrical control unit, the remote controlled valve being opened when the electrical control unit sends the control signal to the remote controlled valve;
- a plunger pump for supplying a highly pressurized liquid, the plunger pump being connected to the electrical control unit in order to supply the highly pressurized liquid when the control signal is inputted to the plunger pump from the electrical control unit;
- a spraying nozzle assembly for spraying the highly pressurized liquid towards a fire, the spraying nozzle assembly applying a centrifugal force to the highly pressurized liquid passing therethrough, the highly pressurized liquid being transformed into fine particles when sprayed out to the fire;
- a first liquid pipe disposed between the plunger pump and the remote controlled valve in order to guide the highly pressurized liquid from the plunger pump to the remote controlled valve; and
- a second liquid pipe disposed between the remote controlled valve and the spraying nozzle assembly in order to guide the highly pressurized liquid from the remote controlled valve to the spraying nozzle assembly.

According to one embodiment of the present invention, the spraying nozzle assembly includes a frame having an opening end at an upper portion thereof and four screw holes at an underside thereof, a cap member connected to the second liquid pipe so as to receive the highly pressurized liquid from the second liquid pipe, and four nozzle sections which are screw-coupled into the screw holes in order to spray the highly pressurized liquid toward the fire. Each screw hole is regularly spaced out apart from an adjacent screw hole. The cap member is assembled into the opening end of the frame. The underside of the frame is sloped at a predetermined angle so that the highly pressurized liquid sprays extensively to the exterior. The cap member has a disc shape and is provided at an upper surface thereof with a hollow cylindrical portion connected to the second liquid pipe.

Each nozzle section includes a hollow nozzle body having a center hole and a thread-type hole, a swirler accommodated in the hollow nozzle body in order to apply the centrifugal force to the highly pressurized liquid passing therethrough, a swirler holder accommodated in the thread-type hole, and a nozzle tip having an orifice for spraying the pressurized liquid to the fire. The nozzle tip is inserted in a terminal end of the center hole, and is formed integrally with the hollow nozzle body.

The hollow nozzle body includes a head portion having a polygonal shape, a thread portion which is screw-coupled into the screw hole of the frame, and a ridge portion disposed between the head portion and the thread portion.

The swirler has a cylindrical body formed at a center thereof with a center bore. The cylindrical body is provided at a cylindrical outer wall thereof with first to fourth slots which are regularly spaced out apart from each other so as to guide the highly pressurized liquid into the nozzle tip. The cylindrical body has a cutting portion at an underside thereof for guiding the highly pressurized liquid that has passed through the slots into the orifice of the nozzle tip. The first to fourth slots of the swirler are offset with respect to the orifice of the nozzle tip so that the pressurized liquid being flowed into the orifice of the nozzle tip passing through the first to fourth slots is subjected to a centrifugal force.

The swirler holder has a cylindrical shape and is formed at the center thereof with an opening for receiving the highly pressurized liquid. The swirler holder is integrally formed at an underside thereof with four protuberances which are regularly spaced out apart from an adjacent protuberance. The protuberances are contacted with an upper surface of the swirler. The swirler holder has an outer cylindrical wall which is formed with a thread so that the swirler holder is screw-coupled into the thread-type hole of the hollow nozzle body.

The fire extinguishing apparatus constructed as described above operates as follows.

When a fire breaks out in a room, the smoke or heat sensor installed in the room senses the temperature or the smoke in the room and transfers a fire signal to the electrical control unit. Upon receiving the fire signal, the electrical control unit sends open and operating signals to the remote controlled valve and the plunger pump, respectively.

As the operating signal is sent to the plunger pump, the plunger pump transfers the pressurized liquid to the spraying nozzle assembly.

The pressurized liquid that has been supplied to the spraying nozzle assembly flows into the orifice of the nozzle tip. At this time, the pressurized liquid is subjected to the centrifugal force while passing through the swirler.

Then, the pressurized liquid sprays to the exterior through the orifice.

While spraying to the exterior, the pressurized liquid is transformed into the fine particles due to the differential pressure between the pressurized liquid and the exterior, thereby effectively extinguishing the fire.

As described above, the fire extinguishing apparatus having the spraying nozzle assembly according to the present invention sprays the fine particles to a fire, thereby not only rapidly extinguishing the fire by using a small quantity of liquid, but also restraining the development of the fire.

Furthermore, since the sensors for sensing a fire are installed in the room, the sensors can instantly respond to fire factors, such as smoke or high temperatures. As a result, it is possible to detect and extinguish the fire in the early stages.

BRIEF DESCRIPTION OF THE DRAWINGS

The above objects and other advantages of the present invention will become more apparent by describing in detail the preferred embodiments thereof with reference to the attached drawings, in which.

DESCRIPTION OF THE PREFERRED EMBODIMENTS

Hereinafter, the present invention will be described in detail with reference to the accompanying drawings.

Figure 1:
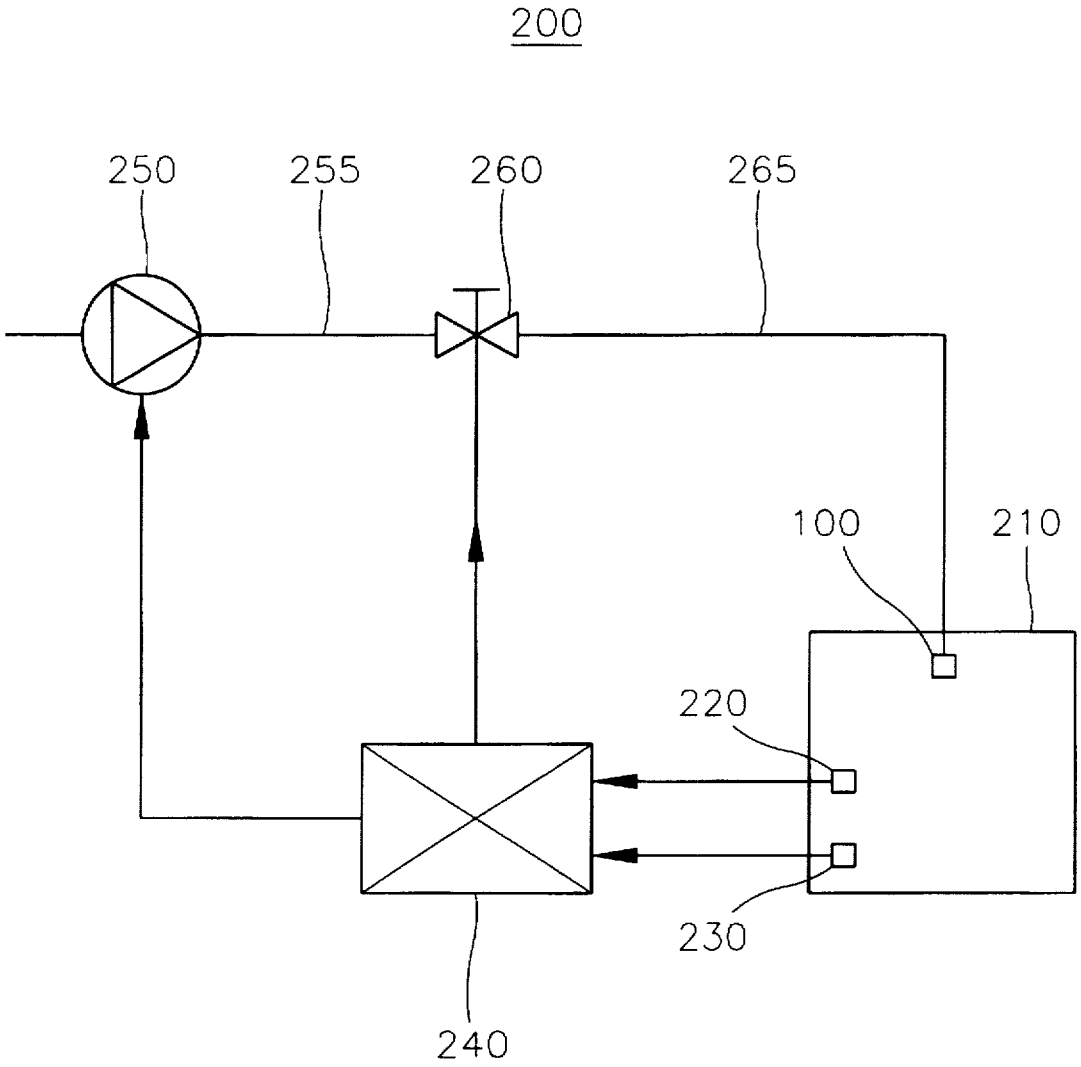
FIG. 1 is a schematic view showing the structure of a fire extinguishing apparatus according to one embodiment of the present invention.

FIG. 1 shows a fire extinguishing apparatus 200 according to one embodiment of the present invention.

As shown in FIG. 1, fire extinguishing apparatus 200 has a smoke sensor 220 installed in a room 210 so as to sense the smoke in room 210, a heat sensor 230 installed in room 210 in order to sense the temperature in room 210, an electrical control unit 240 which is connected to both smoke sensor 220 and heat sensor 230 such that it generates a control signal as a fire signal is inputted from either smoke sensor 220 or heat sensor 230, a plunger pump 250 connected to electrical control unit 240 in order to supply a pressurized liquid when the control signal is inputted from electrical control unit 240, a remote controlled valve 260 which is connected to electrical control unit 240 and is opened as electrical control unit 240 generates the control signal, and a spraying nozzle assembly 100 which ejects the pressurized liquid in the form of spray to a fire.

In order to supply the pressurized liquid from the liquid source to spraying nozzle assembly 100, a first liquid pipe 255 is disposed between plunger pump 250 and remote controlled valve 260, and a second liquid pipe 265 is disposed between remote controlled valve 260 and spraying nozzle assembly 100.

Figure 2:
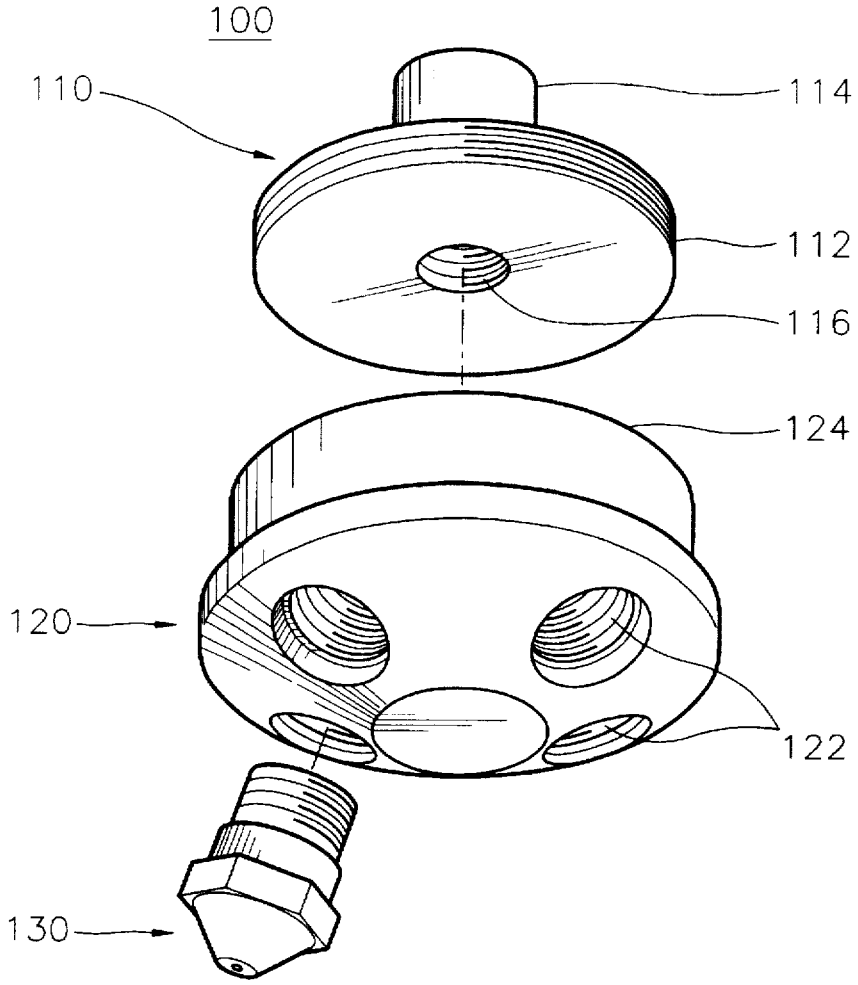
FIG. 2 is an exploded view of a spraying nozzle assembly according to one embodiment of the present invention.

FIG. 2 shows spraying nozzle assembly 100 in detail. As shown in FIG. 2, spraying nozzle assembly 100 includes a frame 120 having an opening end 124 at its upper portion. Frame 120 has a plurality of screw holes 122 which are regularly disposed at the underside of frame 120. Spraying nozzle assembly 100 also includes a cap member 110 which is assembled into opening end 124 of frame 120 and is connected to second liquid pipe 265 so as to receive the pressurized liquid. A plurality of nozzle sections 130 are screw-coupled into screw holes 122 such that they can spray the pressurized liquid toward a fire.

According to the preferred embodiment of the present invention, spraying nozzle assembly 100 has four screw holes 122 and four nozzle sections 130.

Cap member 110 has a disc shape and is provided at its upper surface with a cylindrical portion 114 connected to second liquid pipe 265. Cap member 110 also has a perforation hole 116 at the center thereof and is formed at its circumference 112 with a thread so that cap member 110 may be screw-coupled into opening end 124 of frame 120.

In addition, the underside of frame 120 is sloped at a predetermined angle so that the pressurized liquid may extensively spray to the exterior through nozzle sections 130.

Figure 3:
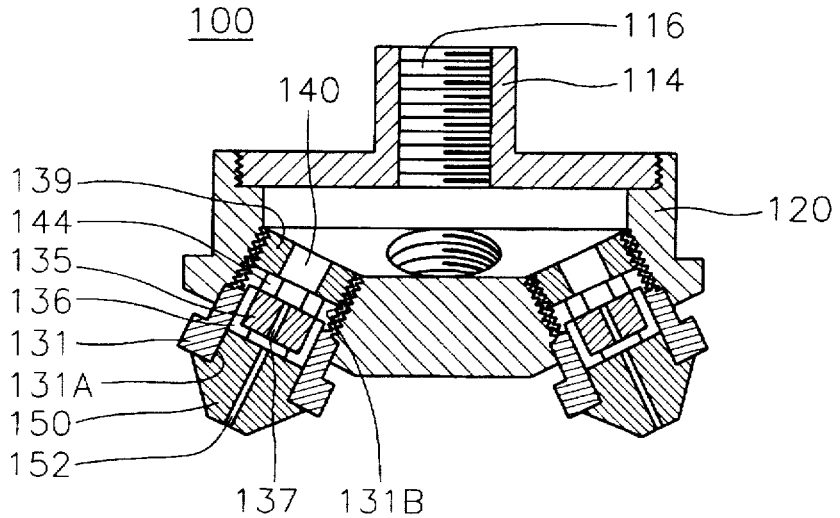
FIG. 3 is a sectional view of the spraying nozzle assembly shown in FIG. 2.

As shown in FIG. 3, each nozzle section 130 comprises a hollow nozzle body 131 having a center hole 131A and thread-type hole 131B. Each nozzle section 130 also includes a swirler 135 which is accommodated in hollow nozzle body 131 in order to apply centrifugal force to the pressurized liquid passing therethrough, a swirler holder 139 which is screw-coupled into thread-type hole 131B and contacts with swirler 135, and a nozzle tip 150 inserted in the terminal end of center hole 131A for spraying the pressurized liquid to the fire.

Though nozzle tip 150 is described as a separated element in the drawings, according to another embodiment of the present invention, nozzle tip 150 may be formed integrally with hollow nozzle body 131. In addition, thread-type hole 131B has an inner diameter larger than that of center hole 131A in such a manner that swirler 135 can be easily assembled into center hole 131A of hollow nozzle body 131.

Figure 4:
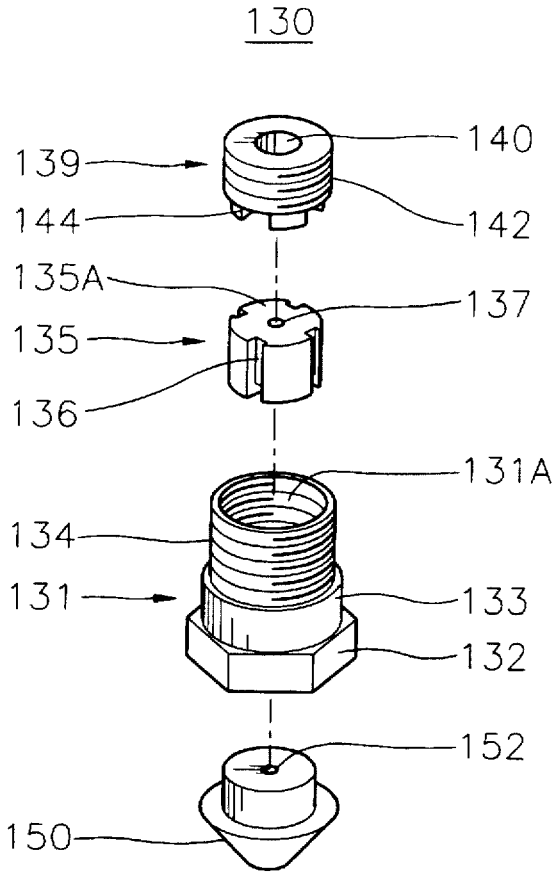
FIG. 4 is an exploded view of a nozzle section according to the one embodiment of the present invention.

FIG. 4 shows the structure of nozzle section 130 in detail. As shown in FIG. 4, hollow nozzle body 131 has a head portion 132 having a polygonal shape. Since head portion 132 has the polygonal shape, a user can easily assemble hollow nozzle body 131 into screw hole 122 by manual work. Hollow nozzle body 131 also includes a thread portion 134 which is screw-coupled into screw hole 122, and a ridge portion 133 disposed between head portion 132 and thread portion 134.

Swirler 135 has a cylindrical body 135A and is formed at the center thereof with a center bore 137. Cylindrical body 135A of swirler 135 is formed at its cylindrical outer wall with a plurality of slots 136 which are regularly spaced out apart from each other so as to guide the pressurized liquid into nozzle tip 150. In addition, a center area of an underside of cylindrical body 135A is cut away at a predetermined depth in such a manner that the pressurized liquid that has passed through slots 136 can be easily guided into nozzle tip 150. According to the preferred embodiment of the present invention, swirler 135 has four slots 136.

Swirler holder 139 has a cylindrical shape and is formed at the center thereof with an opening 140 into which the pressurized liquid is guided from perforation hole 116 of cap member 110. Swirler holder 139 is integrally formed at its underside with a plurality of protuberances 144 which are regularly spaced out apart from each other. According to the preferred embodiment of the present invention, swirler holder 139 has four protuberances 144. Protuberances 144 contact with the upper surface of swirler 135. Swirler holder 139 has an outer cylindrical wall 142 which is formed with a thread, in such a manner that swirler holder 139 can be screw-coupled into thread-type hole 131B of hollow nozzle body 131.

In addition, nozzle tip 150 which is inserted in center hole 131A of hollow nozzle body 131 has an orifice 152 for guiding the pressurized liquid to the fire. Orifice 152 is concentrically disposed with respect to center bore of 137 of swirler 135.

Figure 5:
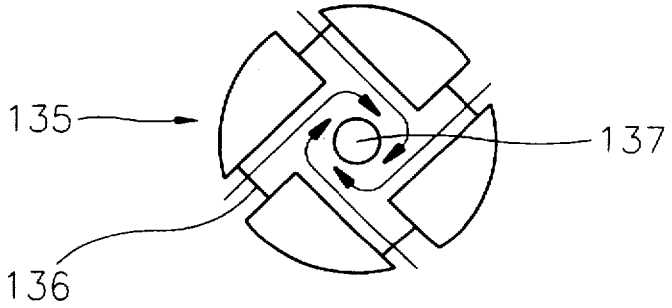
FIG. 5 is a bottom view of a swirler shown in FIG. 4.

As shown in FIG. 5 which is a bottom view of swirler 135, slots 136 of swirler 135 are offset with respect to center bore 137 of swirler 135 so that the pressurized liquid passing through slots 136 is eccentrically guided into orifice 152 of nozzle tip 150 as indicated by arrows in FIG. 5. Accordingly, the pressurized liquid being flowed into orifice 152 of nozzle tip 150 by passing through slots 136 is subjected to a centrifugal force.

Fire extinguishing apparatus 200 being constructed as described above according to one embodiment of the present invention operates as follows.

When a fire breaks out in room 210, smoke sensor 220 or heat sensor 230 installed in room 210 senses the temperature or the smoke in room 210 and transfers a fire signal to electrical control unit 240. Upon receiving the fire signal, electrical control unit 240 sends open and operating signals to remote controlled valve 260 and plunger pump 250, respectively.

When the operating signal is sent to plunger pump 250, plunger pump 250 applies pressure to a liquid supplied from a liquid source, and then transfers the pressurized liquid to spraying nozzle assembly 100 by way of first liquid pipe 255, remote controlled valve 260, and second liquid pipe 265.

As shown in FIG. 3, the pressurized liquid that has been supplied to spraying nozzle assembly 100 flows into nozzle sections 130 through perforation hole 116 of cap member 110 and then sprays to the fire through orifice 152 of nozzle tip 150.

That is, the pressurized liquid that has flowed through perforation hole 116 of cap member 110 may flow into opening 140 of swirler holder 139. Then, the pressurized liquid passes through both center bore 137 and slots 136 of swirler 135, and flows into orifice 152 of nozzle tip 150.

At this time, since slots 136 are offset with respect to orifice 152 of nozzle tip 150, the pressurized liquid flowed into orifice 152 of nozzle tip 150 passing through slots 136 may be subjected to centrifugal force. As a result, the pressurized liquid flowing into orifice 152 forms a swirl-shaped liquid flow.

In the meantime, since orifice 152 has a narrow sectional area, pressure of the pressurized liquid may drop while passing through orifice 152; therefore, the velocity of the pressurized liquid may increase while passing through orifice 152, thereby the pressurized liquid may rapidly spray to the exterior.

While spraying to the exterior, the pressurized liquid is transformed into fine particles due to the differential pressure between the pressurized liquid and the exterior, thereby effectively extinguishing the fire.

On the other hand, since the pressurized liquid has been subjected to centrifugal force, the pressurized liquid may be easily transformed into the fine particles and dispersed at a proper angle to the exterior.

The fine particles not only cool the heat from the fire, but also rapidly vaporize while producing vapor. Therefore, the oxygen content of the air may reduce, thereby restraining the development of the fire.

Since the underside of frame 120, in which nozzle sections 130 are regularly disposed, is sloped at a predetermined angle, the fine particles are more widely dispersed to the exterior.

According to tests made by the inventors of the present invention, the average size of the sprayed liquid particles according to the present invention measures about 100 μm which is smaller than the average size (about 1 mm) of the liquid particles sprayed from standard sprinkler system. In addition, the fire extinguishing apparatus requires about 1.3 l/min·m$^2$ of liquid. Therefore, as compared with the standard sprinkler system which requires about 4.0 l/min·m$^2$ of liquid, the fire extinguishing apparatus of the present invention may save the quantity of liquid.

As described above, the fire extinguishing apparatus having the spraying nozzle assembly according to the present invention sprays the fine particles to a fire, thereby not only rapidly extinguishing the fire by using a small quantity of liquid, but also restraining the development of the fire.

Furthermore, since the sensors for sensing a fire are installed in the room, the sensors can instantly respond to fire factors, such as smoke or high temperatures. As a result, it is possible to detect and extinguish the fire in the early stages.

While the present invention has been particularly shown and described with reference to the preferred embodiments thereof, it will be understood by those skilled in the art that various changes in form and details may be effected therein without departing from the spirit and scope of the invention as defined by the appended claims.

What is claimed is:

1. A fire extinguishing apparatus comprising:

a smoke sensor installed in a room for sensing smoke in the room;

a heat sensor installed in the room for sensing temperature in the room;

an electrical control unit connected to both the smoke and heat sensors for generating a control signal when a fire sensing signal is inputted to the electrical control unit from the smoke sensor or the heat sensor;

a remote controlled valve connected to the electrical control unit, the remote controlled valve being opened when the electrical control unit sends the control signal to the remote controlled valve;

a plunger pump for supplying a highly pressurized liquid, the plunger pump being connected to the electrical control unit in order to supply the highly pressurized liquid when the control signal is inputted to the plunger pump from the electrical control unit;

a spraying means for spraying the highly pressurized liquid towards a fire, the spraying means applying a centrifugal force to the highly pressurized liquid passing therethrough, the highly pressurized liquid being transformed into fine particles when sprayed out to the fire;

a first liquid pipe disposed between the plunger pump and the remote controlled valve in order to supply the highly pressurized liquid from the plunger pump to the remote controlled valve; and a second liquid pipe disposed between the remote controlled valve and the spraying means in order to supply the highly pressurized liquid from the remote controlled valve to the spraying means;

wherein the spraying means including a spraying nozzle assembly, the spraying nozzle assembly comprising a frame having an opening end at an upper portion thereof and a plurality of screw holes at an underside thereof, a cap member connected to the second liquid pipe so as to receive the highly pressurized liquid from the second liquid pipe, and a plurality of nozzle sections which are screw-coupled into the screw holes in order to spray the highly pressurized liquid toward the fire, each screw hole being regularly spaced out apart from each other, the cap member being assembled into the opening end of the frame, each nozzle section including a hollow nozzle body having a center hole and a thread-type hole, a swirler accommodated in the hollow nozzle body in order to apply the centrifugal force to the highly pressurized liquid passing therethrough, a swirler holder which is accommodated in the thread-type hole and contacts with an upper surface of the swirler, and a nozzle tip having an orifice for spraying the pressurized liquid to the fire, the nozzle tip being inserted in a terminal end of the center hole.

2. The fire extinguishing apparatus as claimed in claim 1, wherein the spraying nozzle assembly has four screw holes and four nozzle sections.

3. The fire extinguishing apparatus as claimed in claim 1, wherein the underside of the frame is sloped at a predetermined angle so that the highly pressurized liquid extensively sprays to an exterior.

4. The fire extinguishing apparatus as claimed in claim 1, wherein the cap member has a disc shape and is provided at an upper surface thereof with a hollow cylindrical portion connected to the second liquid pipe.

5. The fire extinguishing apparatus as claimed in claim 1, wherein for each nozzle section, the nozzle tip is formed integrally with the hollow nozzle body.

6. The fire extinguishing apparatus as claimed in claim 1, wherein for each nozzle section, the hollow nozzle body includes a head portion having a polygonal shape, a thread portion which is screw-coupled into one of the screw holes of the frame, and a ridge portion disposed between the head portion and the thread portion.

7. The fire extinguishing apparatus as claimed in claim 1, wherein for each nozzle section, the swirler has a cylindrical body formed at a center thereof with a center bore, the cylindrical body being provided at a cylindrical outer wall thereof with a plurality of slots which are regularly spaced out apart from each other so as to guide the highly pressurized liquid into the orifice of the nozzle tip, each slot being offset with respect to the orifice of the nozzle tip.

8. The fire extinguishing apparatus as claimed in claim 7, wherein for each nozzle section, a center area of an underside of the cylindrical body is cut away at a predetermined depth in order to guide the highly pressurized liquid that has passed through the slots into the nozzle tip.

9. The fire extinguishing apparatus as claimed in claim 7, wherein for each nozzle section, the swirler has four slots.

10. The fire extinguishing apparatus as claimed in claim 1, wherein for each nozzle section, the swirler holder has a cylindrical shape and is formed at a center thereof with an opening for receiving the highly pressurized liquid, the swirler holder being integrally formed at an underside thereof with a plurality of protuberances which are regularly spaced out apart from each other.

11. The fire extinguishing apparatus as claimed in claim 10, wherein for each nozzle section, the swirler holder has four protuberances, and the protuberances contact with the upper surface of the swirler.

12. The fire extinguishing apparatus as claimed in claim 11, wherein for each nozzle section, an outer cylindrical wall of the swirler holder is formed with a thread, so that the swirler holder is screw-coupled into the thread-type hole of the hollow nozzle body.

13. A fire extinguishing apparatus comprising:

a smoke sensor installed in a room for sensing smoke in the room;

a heat sensor installed in the room for sensing temperature in the room;

an electrical control unit connected to both the smoke and heat sensors for generating a control signal when a fire sensing signal is inputted to the electrical control unit from the smoke sensor or the heat sensor;

a remote controlled valve connected to the electrical control unit, the remote controlled valve being opened when the electrical control unit sends the control signal to the remote controlled valve;

a plunger pump for supplying a highly pressurized liquid, the plunger pump being connected to the electrical control unit in order to supply the highly pressurized liquid when the control signal is inputted to the plunger pump from the electrical control unit;

a spraying nozzle assembly for spraying the highly pressurized liquid towards a fire, the spraying nozzle assembly applying a centrifugal force to the highly pressurized liquid passing therethrough, the highly pressurized liquid being transformed into fine particles when sprayed out to the fire;

a first liquid pipe disposed between the plunger pump and the remote controlled valve in order to guide the highly pressurized liquid from the plunger pump to the remote controlled valve; and a second liquid pipe disposed between the remote controlled valve and the spraying nozzle assembly in order to guide the highly pressurized liquid from the remote controlled valve to the spraying nozzle assembly;

the spraying nozzle assembly including a frame having an opening end at an upper portion thereof and four screw holes at an underside thereof, a cap member connected to the second liquid pipe so as to receive the highly pressurized liquid from the second liquid pipe, and four nozzle sections which are screw-coupled into the screw holes in order to spray the highly pressurized liquid toward the fire, each screw hole being regularly spaced out apart from each other, the cap member being assembled into the opening end of the frame, the underside of the frame being sloped at a predetermined angle so that the highly pressurized liquid extensively sprays out to the fire, the cap member having a disc shape and being provided at an upper surface thereof with a hollow cylindrical portion connected to the second liquid pipe, each nozzle section including a hollow nozzle body having a center hole and a thread-type hole, a swirler accommodated in the hollow nozzle body in order to apply the centrifugal force to the highly pressurized liquid passing therethrough, a swirler holder accommodated in the thread-type hole, and a nozzle tip having an orifice for spraying the pressurized liquid to the fire, the nozzle tip being inserted in a terminal end of the center hole, the hollow nozzle body including a head portion having a polygonal shape, a thread portion which is screw-coupled into one of the screw holes of the frame, and a ridge portion disposed between the head portion and the thread portion, the swirler having a cylindrical body formed at a center thereof with a center bore, the cylindrical body being provided at a cylindrical outer wall thereof with four slots which are regularly spaced out apart from each other so as to guide the highly pressurized liquid into the orifice of the nozzle tip, the slots being offset with respect to the orifice of the nozzle tip, the cylindrical body having a cutting portion at a center area thereof for guiding the highly pressurized liquid that has passed through the slots into the orifice of the nozzle tip, the swirler holder having a cylindrical shape and being formed at a center thereof with an opening for receiving the highly pressurized liquid, the swirler holder being integrally formed at an underside thereof with four protuberances which are regularly spaced out apart from each other, the protuberances being contacted with an upper surface of the swirler, the swirler holder having an outer cylindrical wall formed with a thread so that the swirler holder is screw-coupled into the thread-type hole of the hollow nozzle body.

* * * * *